US005753168A

United States Patent [19]

Palmer

[11] Patent Number: 5,753,168

[45] Date of Patent: May 19, 1998

[54] PROCESS FOR MANUFACTURING HIGH MODULUS, LOW SHRINKAGE POLYESTER MONOFILAMENTS OF VERY UNIFORM DIAMETERS

[76] Inventor: Walter M. Palmer, 100 Crestview Dr. #1, Greeneville, Tenn. 37745-0973

[21] Appl. No.: 853,664

[22] Filed: May 9, 1997

[51] Int. Cl.[6] ..... D01D 1/02; D01D 5/16

[52] U.S. Cl. ..... 264/210.2; 264/210.5; 264/210.8; 264/211.12; 264/211.14; 264/211.17; 264/235.6; 264/342 RE

[58] Field of Search ..... 264/210.2, 210.5, 264/210.8, 211.12, 211.14, 211.17, 235.6, 342 RE

[56] References Cited

U.S. PATENT DOCUMENTS 4,060,516 11/1977 Kuratsuji et al. ..... 264/210.8 X

*Primary Examiner*—Leo B. Tentoni

[57] ABSTRACT

This invention discloses an improved process for manufacturing polyester monofilaments in the diameter range 0.1 mm to 0.3 mm with monofilament properties designed for use as the load-bearing, machine direction filaments in papermakers forming fabrics. The properties of the polyester monofilaments of this invention include a high tensile modulus, a low shrinkage, and control of monofilament diameters within ±3%. Process steps include the use of low viscosity polyester granules of Intrinsic Viscosity between 0.5 and 0.6, granules with crystalline skins and amorphous interiors, a low extrusion temperature, and spinneret orifices of cross-sectional area 30% larger than prior art. 1,000 kilograms of polyester monofilaments of uniform diameter may be produced using this improved process without changing the spinneret.

10 Claims, No Drawings

PROCESS FOR MANUFACTURING HIGH MODULUS, LOW SHRINKAGE POLYESTER MONOFILAMENTS OF VERY UNIFORM DIAMETERS

FIELD OF THE INVENTION

This invention relates to an improved process for manufacturing a polyester monofilament used in a papermakers forming fabric.

More particularly the invention concerns a novel process for producing polyester monofilamants of diameters 0.1 mm to 0.3 mm (about 100 to 900 denier) of excellent dimensional stability and uniform diameters along their length.

The polyester monofils of this invention are particularly useful when employed as the load bearing machine direction yarns in single layer forming fabrics with a satin weave.

BACKGROUND OF THE INVENTION

Before describing the properties of these polyester monofils and the processes used to produce them it is desirable to describe the forming fabrics for which the monofils have been designed.

A forming fabric is an endless loop or belt of fabric used in the wet end of a paper machine. The loop of fabric (typically 40 meters loop length and 4 meters wide) is used to screen a moisture laden mass of cellulose fibers during the initial stage of water removal and the fabric loop forms the pulp mass into a uniform wet paper web.

It is important that the loop length and the width of this forming fabric do not change appreciably when the fabric loop is running on the paper machine under tension for several weeks. Thus the load bearing machine direction polyester monofilaments must have a high modulus or a high resistance to stretch.

In addition, the monofils used in a single layer forming fabric must be very uniform in diameter to provide equal spaces between the monofilaments, equal drainage and uniform paper.

Any significant variations in monofil diameters may not allow the forming fabric belt to run flat over the paper machine rolls. If the belt loses contact with the rolls and "ridges" it has to be replaced with a new forming fabric belt at a cost of over $ 10,000.

The monofilaments of this invention are particularly suitable for single layer forming fabrics composed of two sets of yarns woven at right angles to each other. The load bearing yarns are parallel to the motion of the belt and are called "Machine Direction" or MD yarns. The yarns at right angles to the MD yarns, running across the fabric from edge to edge are called "Cross Machine Direction" or CMD yarns. This invention is concerned only with the MD polyester monofilaments.

One of the most popular weaves for single layer forming fabrics is the "satin" weave where all the MD yarns float over 3 or more CMD yarns. The fabric weave is held together and stabilized by passing a CMD yarn over Just one MD yarn forming a small "knuckle" or loop of yarns It is advantageous for better fabric stability and resistance against fabric "skewing" to distribute the knuckles in a more or less random fashion over the two dimensional fabric weave.

To take full advantage of the high modulus MD monofilaments of this invention it is useful to specify the exact location of the knuckles in the fabric weave. If we consider a fabric surface in which the MD yarns are labelled x=1, 2, 3, 4 etc and the CMD yarns y=1, 2 3, 4 etc then the locations (x,y) of the preferred positions of the knuckles in a satin weave are:

| | | |
|---|---|---|
| 4 Yarn Repeat | 1,1 2,2 3,4 4,3 | Pattern 1,2,4,3 |
| 5 Yarn Repeat | 1,1 2,3 3,5 4,4 5,2 | Pattern 1,3,5,4,2 |
| 6 Yarn Repeat | 1.1 2,3 3,5 4,2 5,6 6,4 | Pattern 1,3,5,2,6,4 |

One important characteristic of a single layer satin weave forming fabric is that the load bearing MD yarns are fairly straight (except at the knuckles) and they are buried in the middle of the fabric between its top and bottom surface. This means that any abrasion on the bottom of the fabric due to the paper machine rolls rubs only the CMD yarns. And if the cellulose pulp contains abrasive fillers again it is the CMD yarns on the top surface of the fabric which are subject to abrasion. Thus it is not necessary for the MD yarns of this invention to have a high resistance to abrasion.

Without the requirement of abrasion resistance it is possible to use a polyester polymer of lower viscosity and shorter average molecular lengths. This facilitates the melt extrusion permitting lower extrusion temperatures and more uniform filaments. Additionally by using high filament draws and high temperature annealing it allows the production of monofilaments of good dimensional stability and lower shrinkage due to their high crystallinity and high orientation.

DISCUSSION OF THE PRIOR ART

Since fiber-forming, melt spinnable, synthetic polymers were introduced, fiber manufacturers have looked for ways to increase the strength and stability of the fibers made from these polymers. These properties have allowed multifilament yarns (each filament less than 10 denier) and mono-filaments (each filament greater than 100 denier) to be used in non-textile end-uses such as ropes, tire cords, industrial belts and paper makers fabrics.

Industrial yarns may be produced from several different polymers. Three of the more popular polymers are polyethylene terephthalate (polyester), polyamide (nylon) and olefin (poly-propylene). Polyester stretches less than nylon. Polyester also has better dimension stability than polypropylene, particularly at elevated temperatures. Nylon is sensitive to moisture.

Prior art has shown that it is not always possible to optimize two or more properties of polyester industrial yarns at the same time. For example the use of high yarn stretches produces yarns of high tensile strength but at the same time reduces the elongation to break. Using high molecular weight polyesters (so called high viscosity polyester) provide high resistance to abrasion but tend to increase yarn shrinkage.

Additionally there is sometimes a relation between facility of melt extrusion (and uniformity of extruded product) and final properties of the polyester yarns. For example using a lower viscosity polyester polymer allows lower melt spinning temperatures to be used and results in more uniformity of the diameters of polyester monofils.

Whilst a number of the U.S. Patents quoted below are concerned with polyester yarns of high strength, low stretch and low shrinkage, none of them have the same combination of properties as this invention. Additionally none are designed to produce polyester monofils of 100 to 900 denier of exceptionally good diameter uniformity.

U.S. Pat. No. 5,223,187 describes a process for producing large polyester monfils of 1,000 denier or more with both a high modulus and a low shrinkage using a relatively high molecular weight polymer of 0.7 or higher viscosity.

U.S. Pat. No. 5,186,879 teaches a process for producing polyester filaments of high tenacity, high initial modulus and low shrinkage. This process produces multi-filaments less than 10 denier per filament.

U.S. Pat. No. 5,149,480 teaches the importance of high orientation and high crystallinity in producing dimensionally stable polyester filaments at yarn take up speeds of 3,000 meters per minute. The present invention produces much larger filaments taken up at speeds of about 110 meters per minute. Precise control of the slow draws in my invention leads to monofils of more uniform diameters.

U.S. Pat. No. 5,132,067 is another patent for producing highly dimensionally stable polyester tire yarns using polyester polymers of Intrinsic Viscosity greater than 0.8.

U.S. Pat. No. 5,354,529 teaches a method for producing uniform monofilaments by delivering a pressurized melt to each nozzle or orifice. My invention uses a single pump and a conventional spinneret and achieves the diameter uniformity by a special choice of polyester polymer, and the use of large spinneret orifices and slow filament draws.

SUMMARY OF THE INVENTION

Whilst most polyester industrial yarns are produced from Medium Viscosity Polyester Polymer (Intrinsic Viscosity of 0.7) or High Viscosity (I.V. of 0.9 or 1.0) the polyester monofil of this Invention uses a comparatively low viscosity polyester polymer of Intrinsic Viscosity of only 0.58.

This shorter molecular weight polyester polymer of I.V.= 0.58 allows lower melt extrusion temperatures, provides a more homogeneous melt, generally facilitates the extrusion process and avoids excessive diameter variations in the extruded monofils associated with incompletely melted polymer.

The lower I.V. polyester polymer also leads to lower monofil shrinkage and higher tensile modulus (lower monofil stretch) since the shorter polyester molecules heat set and crystallize more than polyester monofils produced from higher viscosity (longer molecules) polymers.

Using a lower I.V. Polyester Polymer does decrease the Abrasion Resistance of the Melt Extruded Monofilament, but as explained in the section above on "Background of this Invention" a high abrasion resistance is not required in the polyester monofils of this invention.

In processing polyester granules in a Screw Melt Extruder it is necessary that the surface of the granules are crystallized to prevent the granules from sticking together in the heated hopper or in the first stage (compacting) of the screw extrusion process. Whether the polyester granules are purchased as crystalline granules or whether the granules are crystallized in a separate process taking about one hour, the entire volume of the polyester granules are crystallized. In the present invention an amorphous polyester is used and crystallized at a high temperature, e.g. 2300° C. for a very short residence time of the order of 10 minutes. This short heat treatment crystallizes the surface or "skin" of the polyester granule but leaves the interior of the granule essentially amorphous. Since crystalline polyester melts at higher temperatures than amorphous polyester the use of this bi-component granule (crystalline skin and amorphous center) permits lower temperatures to be used in the screw extrusion process.

To follow the features of the present invention it is convenient to follow Tables 1 and 2 which summarize the process conditions and monofilament properties of both a typical prior art process and an exemplary best mode of practicing the present invention. The right hand column of Table 1 identifies the main features of the present invention which differ from prior art.

For Example, lines 13 and 14 of Table 1 show that this invention uses spinneret orifices 30% more cross-sectional area than prior art and draws in the quench bath also 30% higher. This modification produces monofilaments of more uniform diameter as explained in the next paragraph.

One important reason that the diameters of polyester monofils are not uniform is that the spinneret orifices (die holes) tend to get partially blocked or plated. Materials that obstruct the orifices may be monomer (Di-Ethylene Glycol), degradation products of polyester, additives to the polymer (titanium di-oxide or stabilizers), and foreign material accidentally mixed in with the polyester polymer. One troublesome diameter variation, sometimes as large as 5% diameter variation, is caused when the contamination in the spinneret orifice suddenly releases.

TABLE 1

PROCESS CONDITIONS - PRIOR ART & THIS INVENTION

| Process Parameter | Typical Prior Art | Example of this Invention | Comparison: This Invention |
|---|---|---|---|
| 1. Polyester Supplier | Goodyear[1] | Eastman[2] | |
| 2. Intrinsic Viscosity[3] | 0.70 | 0.58 | Lower |
| 3. Granule Crystallinity | Crystalline | Amorphous | |
| 4. Crystallization Temp. | 180° C. | 230° C. | |
| 5. Crystallization Time | 60 mins | 10 mins | Shorter |
| 6. Granule Surface (Skin) | Crystalline | Crystalline | |
| 7. Center of Granule | Crystalline | Amorphous | Amorphous |
| 8. Extrusion Screw Diam. | 90 mm | 60 mm | |
| 9. Extrusion Throughput | 30 kg/hr | 17 kg/hr | |
| 10. Extrusion Polymer Temp. | 28° C. | 275° C. | Lower |
| 11. No. of Spinneret Holes | 80 | 80 | |
| 12. Diam. of Holes | 0.50 mm | 0.57 mm | |
| 13. Area of Holes | 0.20 $mm^2$ | 0.26 $mm^2$ | Larger |
| 14. Draw in Quench Bath, 95° C. | 1.7 x | 2.2 x | Higher |
| 15. Total Line Draw, 230–240° C. | 5.0 x | 5.0 x | |
| 16. Monofil Take-Up Speed | 200 mpm | 110 mpm | |

[1]Goodyear Tire and Ribber Company
[2]Eastman Chemical Company
[3]Viscosity measured in a mixed solvent of 60/40 Phenol/tetrachloroethane at 30° C.

TABLE 2

MONOFILAMENT PROPERTIES - PRIOR ART AND THIS INVENTION

| Monofilament Property | Typical Prior Art | Example of this Invention | Comparison: This Invention |
|---|---|---|---|
| (1) Polyester Monofil Diameter | 0.17 mm | 0.17 mm | |
| (2) Monofil Diameter Uniformity | ±5% | ±3% | Better |
| (3) Monofilament Denier | 280 | 280 | |
| (4) Monofil Tenacity at Break | 5.0 gm/den | 5.0 gm/den | |
| (5) Elongation to Break | 16% | 14% | |
| (6) Tensile Modulus @ 1% Stretch | 1.00 gm/den | 1.15 gm/den | Higher |
| (7) Free Shrinkage @ 20° C. | 1.0% | 0.5% | Lower |
| (8) Abrasion Resistance | Good | Fair | |

The higher than normal Quench Draw of 2.2 x from abnormally large spinneret orifices is achieved by:

(1) The homogeneous low viscosity polymer (2) The slow Monofil Take-Up Speeds (half normal)

(3) Use of Optimum Polymer extrusion Temperature

The optimum temperature of the polyester in the spinneret is obtained experimentally by evaluating the maximum quench draw possible without monofilament breaks in the quench tank. For example, in this invention I found:

| Polymer Temperature at Spinneret | Maximum Quench Draw |
|---|---|
| 270° C. | 2.0 x |
| 275° C. | 2.4 x |
| 280° C. | 2.2 x |

Thus by using a polymer temperature of 275° C. it is possible to stretch or draw the monofils in the hot, 95° C., quench bath as much as 2.4 x without the monofils breaking. To obtain a safety factor and freedom from monofil breaks during regular production, the 275° C. polymer temperature is used and the Quench Draw is backed off to 2.2 x.

The polyester monofilaments of this invention are woven into paper makers forming fabrics. Before the loop of forming fabric is installed on the papermachine, the forming fabric may be stored in inventory for several days. It is important that during this time the loop of forming fabric does not shrink appreciably and make installation on the papermachine difficult. Hence the polyester monofilaments of this invention have been produced from low viscosity polyester polymer giving the nonofils a low Free Shrinkage at 20° C.

As shown in Table 1, the monofilaments of this invention are produced using a convential Total Line Draw of 5.0 x. This 5.0 x draw may be done in one or two steps. The heat setting or annealing of the polyester monofilaments of this invention is done by a standard procedure well-known to those skilled in the art of monofilament production. The annealing takes place at a high temperature of the order of 250° C. and the monofilament is allowed to shrink 0 to 2% in the annealing process. Once the monofilaments of this invention are on the first godet, following the quench draw, the monofil process follows well established practices except for the fact all monofilament speeds are only half the usual speeds employed.

This invention is limited to the production of the polyester monofilaments and does not include the forming fabric weaving, the fabric heat setting or "finishing", or the use of the forming fabric belt on the paper machine. However standard procedures of these "down-stream" processes may be used with the monofilaments of this invention.

PROCESS ADVANTAGES OF THIS INVENTION

In addition to the improved monofilament properties of this invention such as better diameter uniformity, less shrinkage and higher tensile modulus there are process advantages which include:

(1) Spinneret life is improved greatly. It is common practice to change the spinneret when about 200 or 300 kg of 0.17 mm diameter are produced. However it was found in this invention the spinneret orifices contaminated less and 1,000 kg or more monofilaments of diameter ±3% could be produced before the spinneret was changed.

(2) The improved process of this invention which includes using yarn speeds half the typical values results in fewer monofilament breaks on the Extrusion Line and high machine utilisation.

(3) The low shrinkage of the Machine Direction monofilaments of this invention allows the manufacture of forming fabric belts which shrink less in inventory with less chance of being too short when installed on the paper machine several weeks after the fabric was manufacture.

(4) because of the high Tensile Modulus (Low Stretch) of the MD yarns there is less chance of the forming fabric loop stretching off the paper machine even if it is used to make paper for many weeks.

(5) The improved control of the MD monofilament diameters permits better control of the forming fabric thickness and reduces the chances of the fabric "ridging" on the paper machine and necessitating the installation of a new fabric.

(6) The improved uniformity of forming fabrics containing the MD monofilaments of this invention allows the fabric belts to be used at lower tensions on the paper machine and still remain flat. With lower fabric tensions the edges of the satin weave fabric curl up less.

(7) To avoid excessive diameter variations in processes based on prior art it is necessary to make hundreds of diameter measurements on the Extrusion Line or in the Quality Control Laboratory (8) When off-standard monofilament diameters are woven into the forming fabric they have to be removed and mended by hand weaving which is expensive and time consuming.

I claim:

1. A process for manufacturing high modulus, low shrinkage polyester monofilaments with diameters controlled to ±3%, said process comprising the steps of:

(a) providing amorphous polyester granules having an intrinsic viscosity between 0.50 and 0.60;

(b) heat treating the amorphous granules using a temperature of at least 230° C. for a time less than 10 minutes to obtain bi-component granules with crystalline skins and amorphous interiors;

(c) extruding the bi-component polyester granules in a screw extruder using a molten polymer temperature of 270° C. to 280° C.;

(d) using a spinneret with a multiplicity of orifices, the cross-sectional area of each orifice being 11 times the cross-sectional area of the extruded monofilaments;

(e) pumping the molten polyester polymer through the spinneret orifices at a velocity 1/11th of the take-up speed of the monofilaments;

(f) using a 11x draw from spinneret to take-up, composed of a 2.2x draw in a hot water quench tank at 95° C. and a total line draw of 5.0x at 220° C. to 240° C.;

(g) heat treating or annealing the monofilaments in another hot oven at 250° C. whilst allowing the monofilaments to shrink 0 to 2%; and (h) taking up the monofilaments on spools at a speed of 110 meters per minute.

2. The process of claim 1 wherein the polyester monofilaments have diameters between 0.1 mm and 0.3 mm.

3. The process of claim 1 wherein the polyester granules are cubical or cylindrical in shape and of a size between 2mm×2mm×2mm and 4mm×4mm×4mm.

4. The process of claim 1 wherein the spinneret has 40 to 100 orifices permitting the extrusion of 40 to 100 monofilaments on the Extrusion Line.

5. The process of claim 1, wherein the draw in the quench bath in water at 95° C. is at least 2.2x.

6. The process of claim 1 wherein the tensile modulus of the monofilament at 1% stretch is at least 1.1 gm/denier.

7. The process of claim 1 wherein the free shrinkage at 20° C. room temperature is less than 1.0%.

8. The process of claim 1 wherein one spinneret is used to produce 1,000 kilograms of monofilaments before it is changed for a new, clean spinneret.

9. The process of claim 1 wherein a production lot of 1,000 kgs of polyester monofilaments of 0.17 mm diameter is produced from one spinneret and all 32 million meters of monofilament have diameters between 0.165 mm and 0.175 mm.

10. The process of claim 1 wherein the polyester monofilaments are used as the load bearing, machine direction filaments in a makers forming fabrics.

* * * * *